US007284325B2

(12) United States Patent
Thors et al.

(10) Patent No.: US 7,284,325 B2
(45) Date of Patent: Oct. 23, 2007

(54) RETRACTABLE FINNING TOOL AND METHOD OF USING

(76) Inventors: Petur Thors, 4222 Willow Bend Rd. SE., Decatur, AL (US) 35603; Bruce Kouse, 3488 Old Mill Rd., Springfield, OH (US) 45502; Gerry Minshall, The Cottage, Exhall, Alcester Warks (GB) B49 6EA ( * ) Notice: Subject to any disclaimer, the term of this patent is extended or adjusted under 35 U.S.C. 154(b) by 0 days.

(21) Appl. No.: 11/688,563

(22) Filed: Mar. 20, 2007

(65) Prior Publication Data

US 2007/0157456 A1 Jul. 12, 2007

Related U.S. Application Data

(63) Continuation of application No. 11/129,119, filed on May 13, 2005, and a continuation-in-part of application No. 10/458,398, filed on Jun. 10, 2003, and a continuation-in-part of application No. 10/972,734, filed on Oct. 25, 2004.

(60) Provisional application No. 60/570,858, filed on May 13, 2004.

(51) Int. Cl.

| | |
|---|---|
| ***B23P 15/26*** | (2006.01) |
| ***B23P 9/00*** | (2006.01) |
| ***B23P 17/00*** | (2006.01) |
| ***B21D 53/06*** | (2006.01) |

(52) U.S. Cl. ..... 29/890.05; 29/557; 29/566; 29/561; 29/33 T; 29/890.045; 72/71; 408/156; 408/1 R; 82/1.11

(58) Field of Classification Search ..... 29/566, 29/561, 562, 33 T, 890.045, 890.032, 890.046, 29/890.048, 890.049, 890.05, 890.053, 727, 29/56.5, 33 D, 33 R, 557; 72/70–72; 408/154, 408/156, 159, 163, 147, 153, 155, 180, 1 R; 82/1.11; 407/9; 409/131–132

See application file for complete search history.

(56) References Cited

U.S. PATENT DOCUMENTS

| | | | | |
|---|---|---|---|---|
| 2,314,084 | A * | 3/1943 | Armin | 408/147 |
| 3,202,212 | A | 8/1965 | Kritzer | |
| 3,753,364 | A | 8/1973 | Runyan et al | |
| 3,776,018 | A | 12/1973 | Frecnh | |
| 3,847,212 | A | 11/1974 | Withers, Jr. et al | |

(Continued)

FOREIGN PATENT DOCUMENTS

| | | | |
|---|---|---|---|
| EP | 0865838 | A | 9/1998 |

(Continued)

OTHER PUBLICATIONS

International Search Report issued Mar. 18, 2005 for PCT/US04/35099.

(Continued)

*Primary Examiner*—Erica Cadugan
(74) *Attorney, Agent, or Firm*—Kilpatrick Stockton LLP; Kristin J. Doyle

(57) ABSTRACT

An improved tool and method for enhancing the surface of a heat transfer tube are provided. The tool, which can be easily added to existing manufacturing equipment, includes cutting bits that may be retracted with a housing. The cutting bits include a cutting edge to cut through the surface of a tube and a lifting edge to lift the surface of the tube to form protrusions. A method for enhancing the inner surface of the tube includes mounting a tool on a shaft, positioning the tool in the tube and causing relative rotation and axial movement between the tube and the tool to cut at least partially through at least one ridge formed along the surface of the tube to form ridge layers and lift the ridge layers to form protrusions.

18 Claims, 5 Drawing Sheets

U.S. PATENT DOCUMENTS

| | | | | |
|---|---|---|---|---|
| 3,886,639 | A | 6/1975 | Pasternak | |
| 4,166,498 | A | 9/1979 | Fujie et al. | |
| 4,203,311 | A | 5/1980 | O'Conner et al | |
| 4,561,497 | A | 12/1985 | Nakajima et al. | |
| 4,602,681 | A | 7/1986 | Daikoku et al. | |
| 4,606,405 | A | 8/1986 | Nakayama et al. | |
| 4,624,122 | A | 11/1986 | Bridier | |
| 4,646,548 | A | 3/1987 | Zimmerli et al. | |
| 4,653,163 | A | 3/1987 | Kuwahara et al. | |
| 4,672,834 | A * | 6/1987 | Alberto | 72/325 |
| 4,678,029 | A | 7/1987 | Sasaki et al. | |
| 4,706,355 | A | 11/1987 | Kuhns et al. | |
| 4,794,984 | A | 1/1989 | Lin | |
| 4,819,525 | A | 4/1989 | Rabe | |
| 4,938,282 | A | 7/1990 | Zohler | |
| 5,052,476 | A | 10/1991 | Sukumoda et al. | |
| 5,181,810 | A * | 1/1993 | Heule | 408/147 |
| 5,332,034 | A | 7/1994 | Chiang et al. | |
| 5,351,397 | A | 10/1994 | Angeli | |
| 5,458,191 | A | 10/1995 | Chiang et al. | |
| 5,555,622 | A | 9/1996 | Yamamoto et al. | |
| 5,597,039 | A | 1/1997 | Rieger | |
| 5,655,599 | A | 8/1997 | Kasprzyk | |
| 5,669,441 | A | 9/1997 | Spencer | |
| 5,682,946 | A | 11/1997 | Schmidt et al. | |
| 5,690,167 | A | 11/1997 | Rieger | |
| 5,692,560 | A | 12/1997 | Messant et al. | |
| 5,697,430 | A | 12/1997 | Thors et al. | |
| 5,704,424 | A | 1/1998 | Kohno et al. | |
| 5,709,029 | A | 1/1998 | Innes | |
| 5,755,538 | A | 5/1998 | Heule | |
| 5,775,187 | A | 7/1998 | Nikolai et al. | |
| 5,775,411 | A | 7/1998 | Schuez et al. | |
| 5,782,121 | A | 7/1998 | Wetzels | |
| 5,791,405 | A | 8/1998 | Takiura et al. | |
| 5,803,164 | A | 9/1998 | Schuez et al. | |
| 5,803,165 | A | 9/1998 | Shikazono et al. | |
| 5,862,857 | A | 1/1999 | Ishikawa et al. | |
| 5,915,467 | A | 6/1999 | Ishikawa et al. | |
| 5,933,953 | A | 8/1999 | Spencer et al. | |
| 5,934,128 | A | 8/1999 | Takiura et al. | |
| 5,950,716 | A | 9/1999 | Appelquist et al. | |
| 5,950,718 | A | 9/1999 | Sugitani et al. | |
| 5,975,196 | A | 11/1999 | Gaffaney et al. | |
| 5,996,686 | A | 12/1999 | Thors et al. | |
| 6,000,466 | A | 12/1999 | Aoyagi et al. | |
| 6,018,963 | A | 2/2000 | Itoh et al. | |
| 6,026,892 | A | 2/2000 | Kim et al. | |
| 6,056,048 | A | 5/2000 | Takahashi et al. | |
| 6,067,712 | A | 5/2000 | Randlett et al. | |
| 6,164,370 | A | 12/2000 | Robinson et al. | |
| 6,167,950 | B1 | 1/2001 | Gupte et al. | |
| 6,173,762 | B1 | 1/2001 | Ishida et al. | |
| 6,173,763 | B1 | 1/2001 | Sano et al. | |
| 6,176,301 | B1 | 1/2001 | Bennett et al. | |
| 6,176,302 | B1 | 1/2001 | Takahashi et al. | |
| 6,182,743 | B1 | 2/2001 | Bennett et al. | |
| 6,298,909 | B1 | 10/2001 | Fukatami et al. | |
| 6,336,501 | B1 | 1/2002 | Ishikawa et al. | |
| 6,766,817 | B2 | 7/2004 | da Silva | |
| 6,918,404 | B2 | 7/2005 | Dias da Silva | |
| 2006/0112535 | A1 * | 6/2006 | Thors et al. | 29/557 |
| 2006/0213346 | A1 * | 9/2006 | Thors et al. | 83/178 |

FOREIGN PATENT DOCUMENTS

| | | | |
|---|---|---|---|
| EP | 0522985 | B2 | 2/2000 |
| EP | 0845646 | B1 | 9/2001 |
| FR | 2268580 | A | 11/1975 |
| JP | 54068554 | A | 6/1979 |
| JP | 56059194 | A | 5/1981 |
| JP | 62237295 | A | 10/1987 |
| JP | 02034237 | A | 2/1990 |
| JP | 02108410 | A | 4/1990 |
| JP | 02112822 | A | 4/1990 |
| JP | 02133798 | A | 5/1990 |
| JP | 03124337 | A | 5/1990 |
| JP | 03268816 | A | 11/1991 |
| JP | 04009210 | A | 1/1992 |
| JP | 04266418 | A | 9/1992 |
| JP | 04319019 | A | 11/1992 |
| JP | 08099206 | A | 4/1996 |
| JP | 09108759 | | 4/1997 |
| JP | 091471361 | A | 6/1997 |
| JP | 09295037 | A | 11/1997 |
| JP | 10052714 | | 2/1998 |
| JP | 10103886 | | 4/1998 |
| JP | 10197184 | A | 7/1998 |
| JP | 10206061 | A2 | 8/1998 |
| JP | 10281676 | | 10/1998 |
| JP | 11226635 | | 8/1999 |
| JP | 2000193345 | | 7/2000 |
| WO | WO-2005-114086 | A2 * | 12/2005 |

OTHER PUBLICATIONS

International Search Report issued Oct. 10, 2003 for PCT/US03/18304.

Patent Abstracts of Japan, JP-04091819, Mitsubishi Heavy Ltd, Published Mar. 3, 1992.

Patent Abstracts of Japan, JP-04151473, Hitachi Zosen Crop, Published May 5, 1992.

Patent Abstracts of Japan, JP-04333339, Segawa Kihachiro, Published Nov. 20, 1992.

Patent Abstracts of Japan, JP-05106990, Mitsubishi Shindoh Co., Ltd, Published Apr. 27, 1993.

Patent Abstracts of Japan, JP-05231790 Kobe Steel Ltd, Published Sep. 07, 1993.

Patent Abstracts of Japan, JP-08035739, Sumitomo Light Metal Ind Ltd, Published Feb. 06, 1996.

Patent Abstracts of Japan, JP-08313182, Matsushita Electric Ind Co Ltd, Published Nov. 29, 1996.

Patent Abstracts of Japan, JP-09113169, Matsushita Refrig Co Ltd, Published May 02, 1997.

Patent Abstracts of Japan, JP-09141361, Hitachi Cable Ltd, Published Jun. 03, 1997.

* cited by examiner

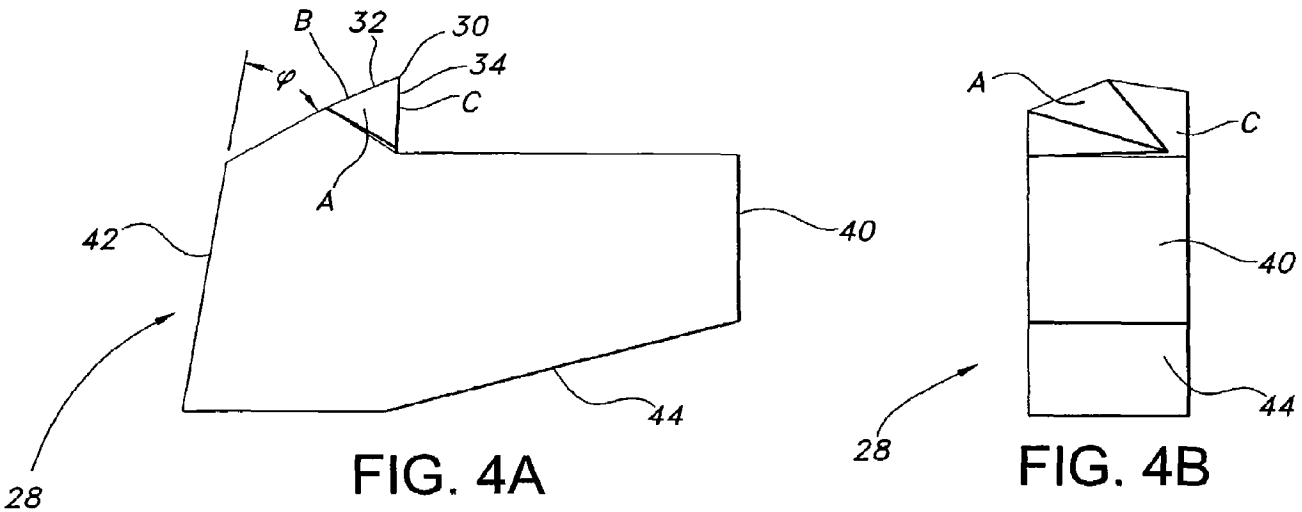
FIG. 4A
FIG. 4B
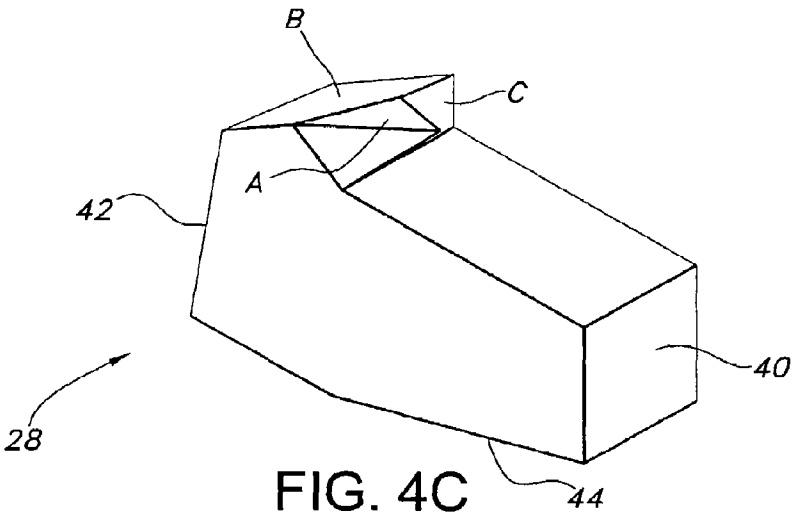
FIG. 4C

RETRACTABLE FINNING TOOL AND METHOD OF USING

CROSS-REFERENCE TO RELATED APPLICATIONS

This application is a continuation of U.S. patent application Ser. No. 11/129,119, filed May 13, 2005, which claims the benefit of U.S. Provisional Patent Application Ser. No. 60/570,858, filed May 13, 2004 and is a continuation-in-part of U.S. patent application Ser. No. 10/458,398, filed on Jun. 10, 2003, and is a continuation-in-part of U.S. patent application Ser. No. 10/972,734, filed on Oct. 25, 2004, the entirety of each of which is incorporated by reference.

BACKGROUND OF THE INVENTION

1. Field of the Invention

The invention relates generally to a tool for forming protrusions on the inner surface of a heat transfer tube and a method for using the tool.

2. General Background of the Invention

This invention relates to heat transfer tubes having an enhanced inner surface to facilitate heat transfer from one side of the tube to the other. Heat transfer tubes are commonly used in equipment, such as, for example, flooded evaporators, falling film evaporators, spray evaporators, absorption chillers, condensers, direct expansion coolers, and single phase coolers and heaters, used in the refrigeration, chemical, petrochemical, and food-processing industries. A variety of heat transfer mediums may be used in these applications, including, but not limited to, pure water, a water glycol mixture, any type of refrigerant (such as R-22, R-134a, R-123, etc.), ammonia, petrochemical fluids, and other mixtures.

An ideal heat transfer tube would allow heat to flow completely uninhibited from the interior of the tube to the exterior of the tube and vice versa. However, such free flow of heat across the tube is generally thwarted by the resistance to heat transfer. The overall resistance of the tube to heat transfer is calculated by adding the individual resistances from the outside to the inside of the tube or vice versa. To improve the heat transfer efficiency of the tube, tube manufacturers have sought to uncover ways to reduce the overall resistance of the tube. One such way is to enhance the outer surface of the tube, such as by forming fins on the outer surface. As a result of recent advances in enhancing the outer tube surface (see, e.g., U.S. Pat. Nos. 5,697,430 and 5,996,686), only a small part of the overall tube resistance is attributable to the outside of the tube. For example, a typical evaporator tube used in a flooded chiller with an enhanced outer surface but smooth inner surface typically has a 10:1 inner resistance:outer resistance ratio. Ideally, one wants to obtain an inside to outside resistance ratio of 1:1. It becomes all the more important, therefore, to develop enhancements to the inner surface of the tube that will significantly reduce the tube side resistance and improve overall heat transfer performance of the tube.

It is known to provide heat transfer tubes with alternating grooves and ridges on their inner surfaces. The grooves and ridges cooperate to enhance turbulence of fluid heat transfer mediums, such as water, delivered within the tube. This turbulence increases the fluid mixing close to the inner tube surface to reduce or virtually eliminate the boundary layer build-up of the fluid medium close to the inner surface of the tube. The boundary layer thermal resistance significantly detracts from heat transfer performance by increasing the heat transfer resistance of the tube. The grooves and ridges also provide extra surface area for additional heat exchange. This basic premise is taught in U.S. Pat. No. 3,847,212 to Withers, Jr. et al.

The pattern, shapes and sizes of the grooves and ridges on the inner tube surface may be changed to further increase heat exchange performance. To that end, tube manufacturers have gone to great expense to experiment with alternative designs, including those disclosed in U.S. Pat. No. 5,791,405 to Takima et al., U.S. Pat. Nos. 5,332,034 and 5,458,191 to Chiang et al, and U.S. Pat. No. 5,975,196 to Gaffaney et al.

In general, however, enhancing the inner surface of the tube has proven much more difficult than the outer surface. Moreover, the majority of enhancements on both the outer and inner surface of tubes are formed by molding and shaping the surfaces. Enhancements have been formed, however, by cutting the tube surfaces.

Japanese Patent Application 09108759 discloses a tool for centering blades that cut a continuous spiral groove directly on the inner surface of a tube. Similarly, Japanese Patent Application 10281676 discloses a tube expanding plug equipped with cutting tools that cut a continuous spiral slot and upstanding fin on the inner surface of a tube. U.S. Pat. No. 3,753,364 discloses forming a continuous groove along the inner surface of a tube using a cutting tool that cuts into the inner tube surface and folds the material upwardly to form the continuous groove.

Manufacturing heat transfer tubes using known cutting tools can be a delicate and often expensive endeavor. Generally, these tools incorporate cutting bits that are always exposed. Thus, as the tool enters the tube, it easily can be damaged. Additionally, known tools can also be damaged when finning is stopped, then restarted. These tools often get stuck in the groove created between the finned section and the smooth section of the tube.

While the tools described above aim to form the desired surface on a heat transfer tube, there remains a need in the industry to continue to improve upon known tools by modifying existing and creating new tools that enhance heat transfer performance. As described below, Applicants have developed new tools for forming surfaces on heat transfer tubes which have significantly improved heat transfer performance.

BRIEF SUMMARY OF THE INVENTION

This invention provides an improved tool and method for enhancing the heat transfer performance of tubes used in at least all of the above-referenced applications (i.e., flooded evaporators, falling film evaporators, spray evaporators, absorption chillers, condensers, direct expansion coolers and single phase coolers and heaters, used in the refrigeration, chemical, petrochemical and food-processing industries). The inner surface of the tube is enhanced with a plurality of protrusions that significantly reduce tube-side resistance and improve overall heat transfer performance. Formation of protrusions in accordance with this invention can result in the formation of up to five times more surface area along the inner surface of the tube than with simple ridges.

Certain embodiments of the invention include using a tool, which can be easily added to existing manufacturing equipment, having a cutting edge to cut through the surface of the tube and a lifting edge to lift the surface of the tube to form protrusions. In this way, protrusions are formed without removal of metal from the inner surface of the tube, thereby eliminating debris that can damage the equipment in which the tubes are used.

Other embodiments of the invention include a tool for cutting the inner surface of a tube. The tool includes a tool axis and at least one tip formed by the intersection of at least a first plane, a second plane and a third plane, and has a cutting edge and a lifting edge. The tool also includes a housing, a spacer and a spring. The spacer applies pressure to a surface of the at least one cutting bit adjacent to the tip and causes the at least one cutting bit to protrude from the housing when frictional or axial forces are exerted on the spacer. The spring is adjacent to a base end of the cutting bit. The spring extends when the forces relax and allows the at least one cutting bit to retract within the housing.

Other embodiments of the invention include a tool for cutting the inner surface of a tube. The tool includes at least one cutting bit with a tool axis and at least one tip formed by the intersection of at least a first plane, a second plane and third plane, and has a cutting edge and a lifting edge.

Other embodiments include a method of enhancing the inner surface of a tube. The method includes mounting a tool onto a shaft, positioning the tool in the tube and causing relative rotation and relative axial movement between the tube and the tool to cut at least partially through at least one ridge formed along the surface of the tube to form ridge layers and subsequently lifting the ridge layers to form protrusions. The tool preferably includes a tool axis and at least one cutting bit formed by the intersection of at least a first plane, a second plane, and a third plane and has a cutting edge and a lifting edge. The tool also includes a housing, a spacer and a spring. The spacer applies pressure to a surface of the at least one cutting bit adjacent to the tip and causes the at least one cutting bit to protrude from the housing when frictional or axial forces are exerted on the spacer. The spring is adjacent to a base end of the cutting bit. The spring extends when the forces relax and allows the at least one cutting bit to retract within the housing.

In a particular embodiment, the cutting edge is formed by the intersection of the first and second planes. In another embodiment, the lifting edge is formed by the intersection of the first and third planes.

In yet another embodiment, the second plane is oriented at an angle relative to a plane perpendicular to the tool axis. In a particular embodiment, the second plane is oriented at an angle between approximately 40° and 70° relative to the plane perpendicular to the tool axis. In a more particular embodiment, the second plane is oriented at an angle such that the cutting edge slices through ridges on a tube surface at an angle between approximately 20° and 50° relative to the plane perpendicular to the tool axis.

In yet another embodiment, the third plane is oriented at an angle relative to a plane perpendicular to the tool axis. In a particular embodiment, the third plane is oriented at an angle between approximately −45° and 45° relative to the plane perpendicular to the tool axis.

In a further embodiment, the cutting edge slices through ridges on an inner surface of the tube at angle between 20° and 50° to create a plurality of protrusions. In a particular embodiment, the lifting edge lifts the plurality of protrusions at an angle of inclination relative to a plane perpendicular to a longitudinal axis of the tube. In a more particular embodiment, the lifting edge lifts the protrusions at approximately −45° and 45° relative to the plane perpendicular to the tool axis.

In a particular embodiment, the tube moves rotationally and axially relative to the tool when the tool is used to cut the inner surface of the tube. In a more particular embodiment, the relative rotation and relative axial movement between the tube and the tool causes the at least one cutting bit to protrude outwardly from the housing. In yet another embodiment, stopping the relative rotation and relative axial movement between the tube and the tool causes the at least one cutting bit to retract inwardly into the housing.

In another embodiment, the cutting edge slices through ridges on an inner surface of the tube at angle between 20° and 50° to create a plurality of protrusions. In a particular embodiment, the lifting edge lifts the protrusions at an angle of inclination relative to the plane perpendicular to the longitudinal axis of the tube. In a more particular embodiment, the lifting edge lifts the protrusions at an angle between approximately −45° and 45° relative to the plane perpendicular to the longitudinal axis of the tube.

BRIEF DESCRIPTION OF THE SEVERAL VIEWS OF THE DRAWINGS

FIG. 4A is a side elevation view of a cutting bit to be used with a tool according to an embodiment of the invention.

FIG. 4B is a bottom plan view of the cutting bit of FIG. 4A.

FIG. 4C is a perspective view of the cutting bit of 4A.

DETAILED DESCRIPTION OF THE INVENTION

In order to increase the surface area of the inner diameter of a heat transfer tube, a pattern may be formed on the inner surface of the tube. Protrusions are commonly used for this purpose. One method of forming protrusions involves first forming ridges on the inner surface. The ridges are then cut to create ridge layers, which are subsequently lifted up to form protrusions. This cutting and lifting may be accomplished using tool 10.

Figure 1:
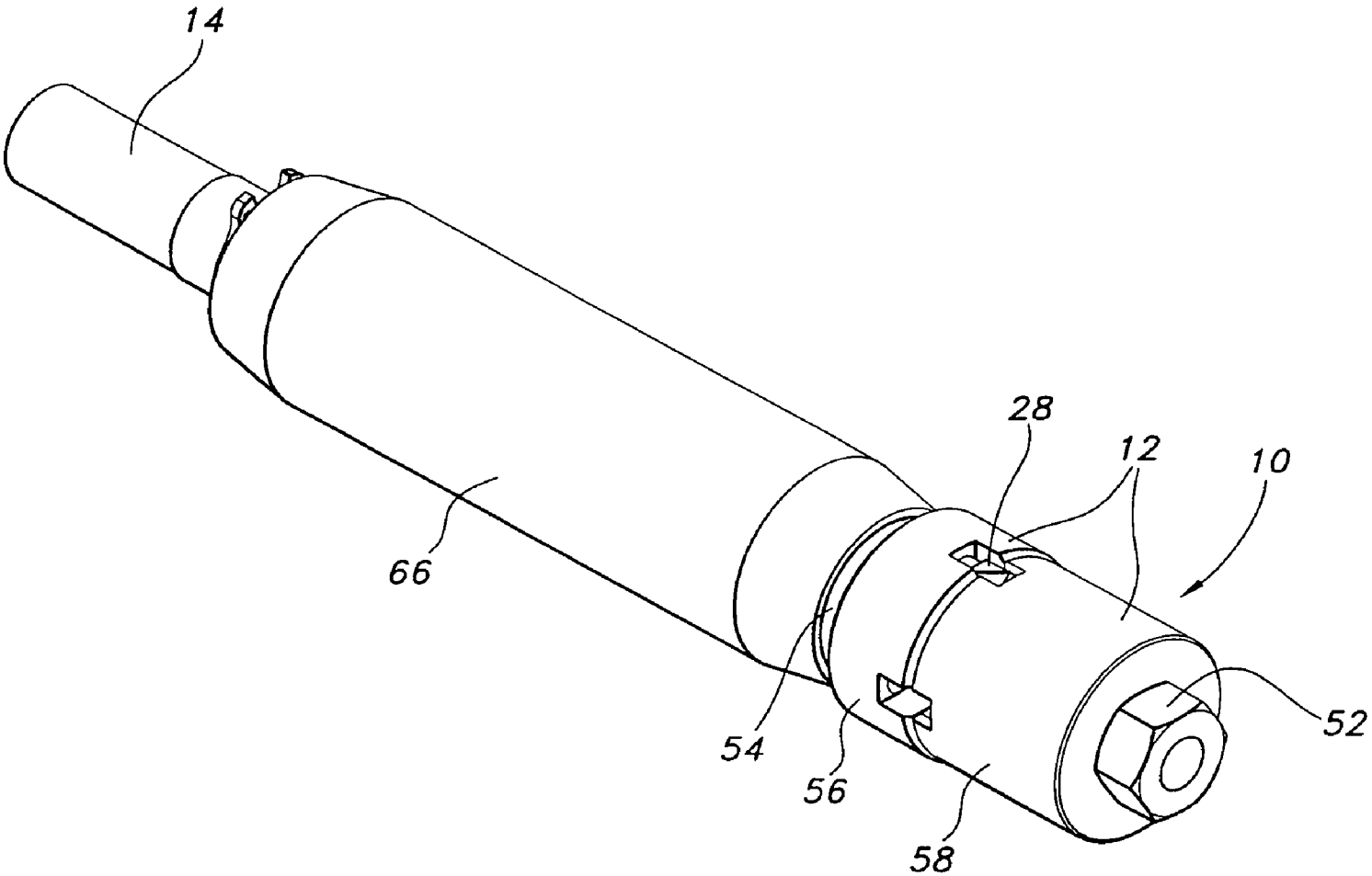
FIG. 1 is a perspective view of tool according to an embodiment of the invention.
Figure 2:
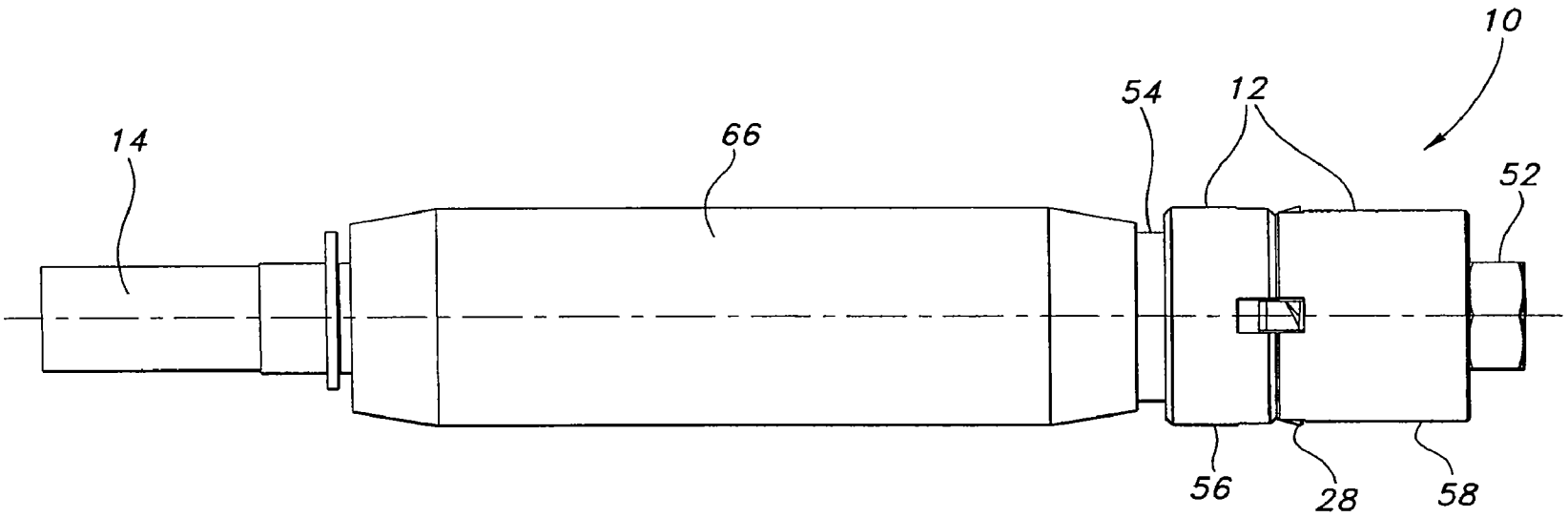
FIG. 2 is a side view of the tool of FIG. 1.

As shown in FIGS. 1 and 2, tool 10 includes housing 12 and at least one cutting bit 28. The cutting bits 28 are retractable within the housing 12. Tool 10 preferably incorporates shaft 14, which may be connected to a rod (not shown).

Figure 3:
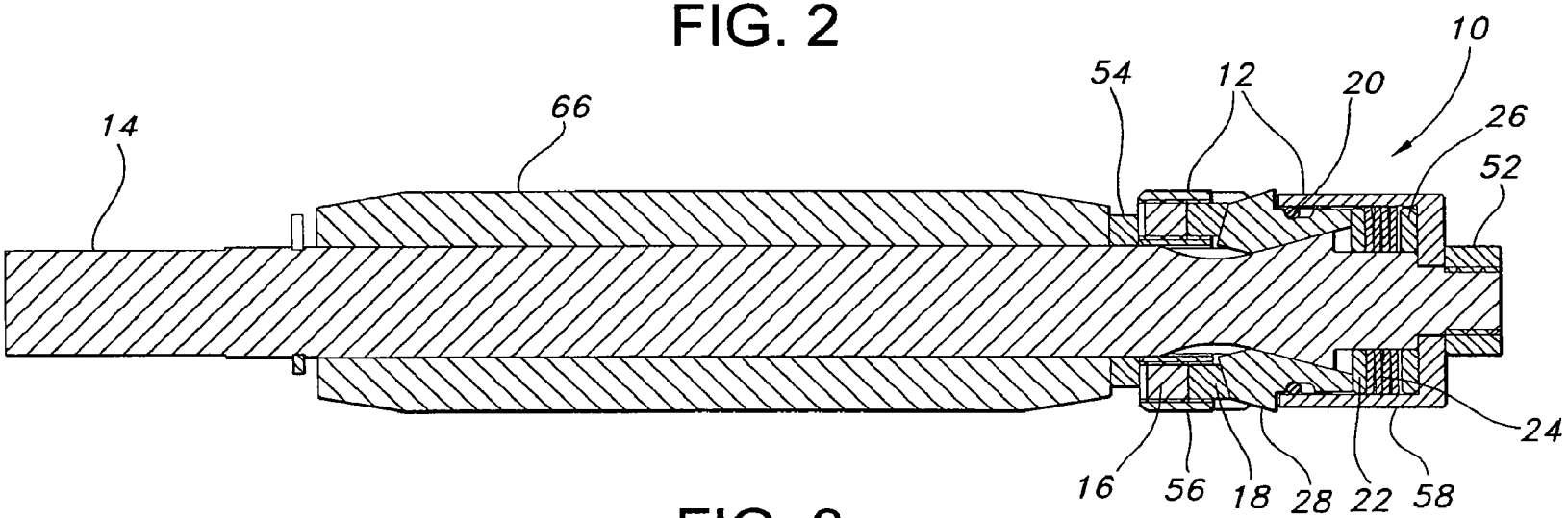
FIG. 3 is a side sectional view of tool according to an embodiment of the invention.

In one embodiment of the invention, the tool 10 includes multiple cutting bits 28. In the example shown in FIG. 1, the tool 10 includes at least four cutting bits 28, although only two are visible. As shown in FIG. 3, cutting bits 28 are held in place in part by ring 20. Ring 20 also holds the cutting bit close to the sliding plane 36 of the shaft 14. The tool 10 further includes a spring 24 for retracting the cutting bit(s) 28. The spring 24 may be a flat, disc or coil spring. As one with skill in the art will understand, any material that can be compressed and expanded, such as rubber may be used in place of spring 24. Spring 24 is preferably separated from the cutting bits 28 by a washer 22, which allows the spring 24 to exert pressure evenly on the cutting bits 28 without sliding over the cutting bits 28. Spacer 18 may be used to prevent pressure from coil spring 24 from damaging housing 12. Spacer 18 may be angled or slanted along the surface in contact with cutting bit 28. This feature assists in keeping cutting bit 28 in place and holds cutting bit 28 in close proximity to the sliding plane 36 of the shaft 14. Screw 16 may be used to secure tool 10 onto shaft 14.

Screw 16 is used to manipulate the maximum diameter the cutting bits 28 protrude from housing 12. In some embodiments, screw 16 is a finely threaded screw. Screw 16 may serve as a way to adjust the maximum cutting bit diameter while the bits are fully extended. Angled spacers 18 may be placed between screw 16 and cutting bit 28 so that screw 16 exerts pressure, but does not damage cutting bits 28.

Housing 12 protects cutting bits 28 when tool 10 is not in use. Additionally, housing 12 works with ring 20, spacer 18 and screw 16 to hold bits 28 in place. In some embodiments, housing 12 is comprised of two separate parts 56, 58. This allows easy accessibility to the individual tool components. It also allows different cutting bits 28 to be used in one tool 10. For example, cutting bit 28 with tips with a particular profile can be used for a period of time, then cutting bit 28 with tips for a different profile can be used in the same tool 10. When a two part housing 12 is used, cutting bit 28 can easily be replaced if it becomes worn or broken.

During manufacture of a heat transfer tube 62, tool 10 may be used to cut through ridges and lift the resulting ridge layers to form protrusions. Tool 10 includes cutting bits 28 that are retractable within housing 12. Cutting bits 28 can be made from any material having the structural integrity to withstand metal cutting (e.g. steel, carbide, ceramic, etc.), but are preferably made of a carbide.

An embodiment of a cutting bit 28 that may be used with tool 10 is shown in FIGS. 4A-C. The cutting bit 28 shown in FIGS. 4A-C generally has an axis q, two base walls 40, 42 and one or more side walls 44. Tip 30 is formed on side walls 44 of cutting bit 28. Note, however, that the tip 30 can be mounted or formed on any structure that can support the tip 30 in the desired orientation relative to the tube and such structure is not limited to that disclosed in FIGS. 4A-C.

One skilled in the art will understand that the geometry of each tip 30 need not be the same for tips 30 on a single cutting bit 28. Rather, tips 30 having different geometries to form protrusions having different shapes, orientations, and other geometries may be provided on cutting bit 28. Moreover, any number of cutting bits 28 may be used with tool 10 depending on the desired pitch $P_{a,p}$ of protrusions.

Each tip 30 of cutting bit 28 is formed by the intersection of planes A, B, and C. The intersection of planes A and B form cutting edge 32 that cuts through ridges to form ridge layers. Plane B is oriented at an angle $\phi$ relative to a plane perpendicular to the tool axis q (see FIG. 4A). Angle $\phi$ is defined as 90'-$\theta$. Thus, angle $\phi$ is preferably between approximately 40°-70° to allow cutting edge to slice through ridges at the desirable angle $\theta$ between approximately 20°-50°.

The intersection of planes A and C form lifting edge 34 that lifts ridge layers upwardly to form protrusions. Angle $\theta_1$, defined by plane C and a plane perpendicular to tool axis q, determines the angle of inclination $\omega$ (the angle between a plane perpendicular to the longitudinal axis s of tube and the longitudinal axis of protrusions at which protrusions are lifted by lifting edge 34. Angle $\phi_1$=angle $\omega$, and thus angle $\theta_1$ on cutting bit 28 can be adjusted to directly impact the angle of inclination $\omega$ of protrusions. The angle of inclination $\omega$ (and angle $\phi_1$) is preferably the absolute value of any angle between approximately −45° to 45° relative to the plane perpendicular to the longitudinal axis s of tube 62. In this way, protrusions can be aligned with the plane perpendicular to the longitudinal axis s of tube or incline to the left and right relative to the plane perpendicular to the longitudinal axis s of tube. Moreover, the tips 30 can be formed to have different geometries (i.e., angle $\phi_1$ may be different on different tips 30), and thus the protrusions within tube may incline at different angles (or not at all) and in different directions relative to the plane perpendicular to the longitudinal axis s of tube.

While preferred ranges of values for the physical dimensions of protrusions have been identified, one skilled in the art will recognize that the physical dimensions of cutting bit 28 may be modified to impact the physical dimensions of resulting protrusions. For example, the depth t that cutting edge 32 cuts into ridges and angle $\phi$ affect the height $e_p$ of protrusions. Therefore, the height $e_p$ of protrusions may be adjusted using the expression:

$$e_p = t/\sin(90-\phi)$$

or, given that $\phi$=90−$\theta$, $$e_p = t/\sin(\theta)$$

Where:

t is the cutting depth;

$\phi$ is the angle between plane B and a plane perpendicular to tool axis q; and $\theta$ is the angle at which the ridge layers are cut relative to the longitudinal axis s of the tube.

Thickness $S_p$ of protrusions depends on pitch $P_{a,p}$ of protrusions and angle $\phi$. Therefore, thickness $S_p$ can be adjusted using the expression:

$$S_p = P_{a,p} \cdot \sin(90-\phi)$$

or, given that $\phi$=90−$\theta$, $$S_p = P_{a,p} \cdot \sin(\theta)$$

Where:

$P_{a,p}$ is the axial pitch of protrusions;

$\phi$ is the angle between plane B and a plane perpendicular to tool axis q; and $\theta$ is the angle at which the ridge layers are cut relative to the longitudinal axis s of the tube.

Figure 5:
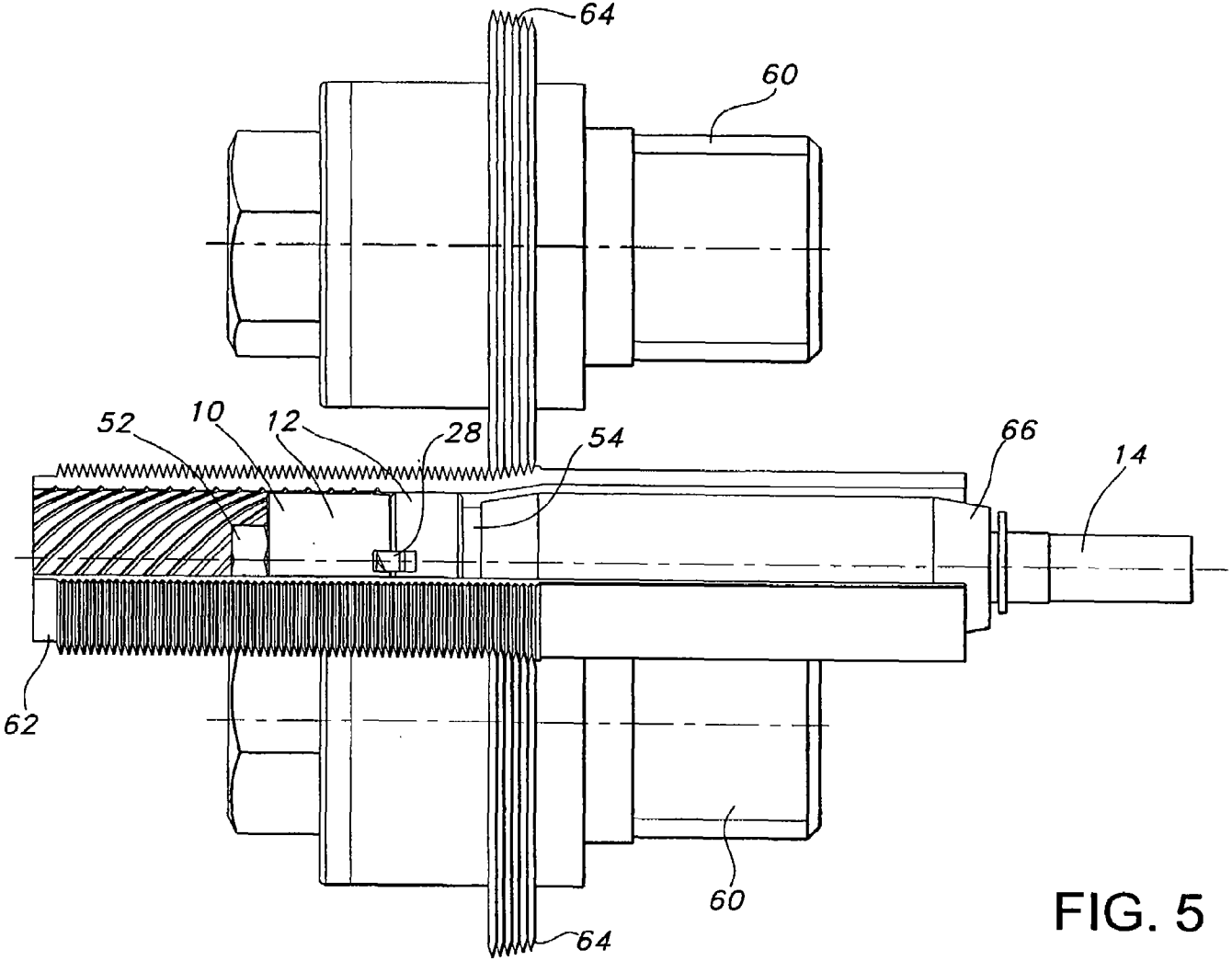
FIG. 5 is a side elevation view of manufacturing equipment incorporating an embodiment of the tool of this invention.
Figure 6:
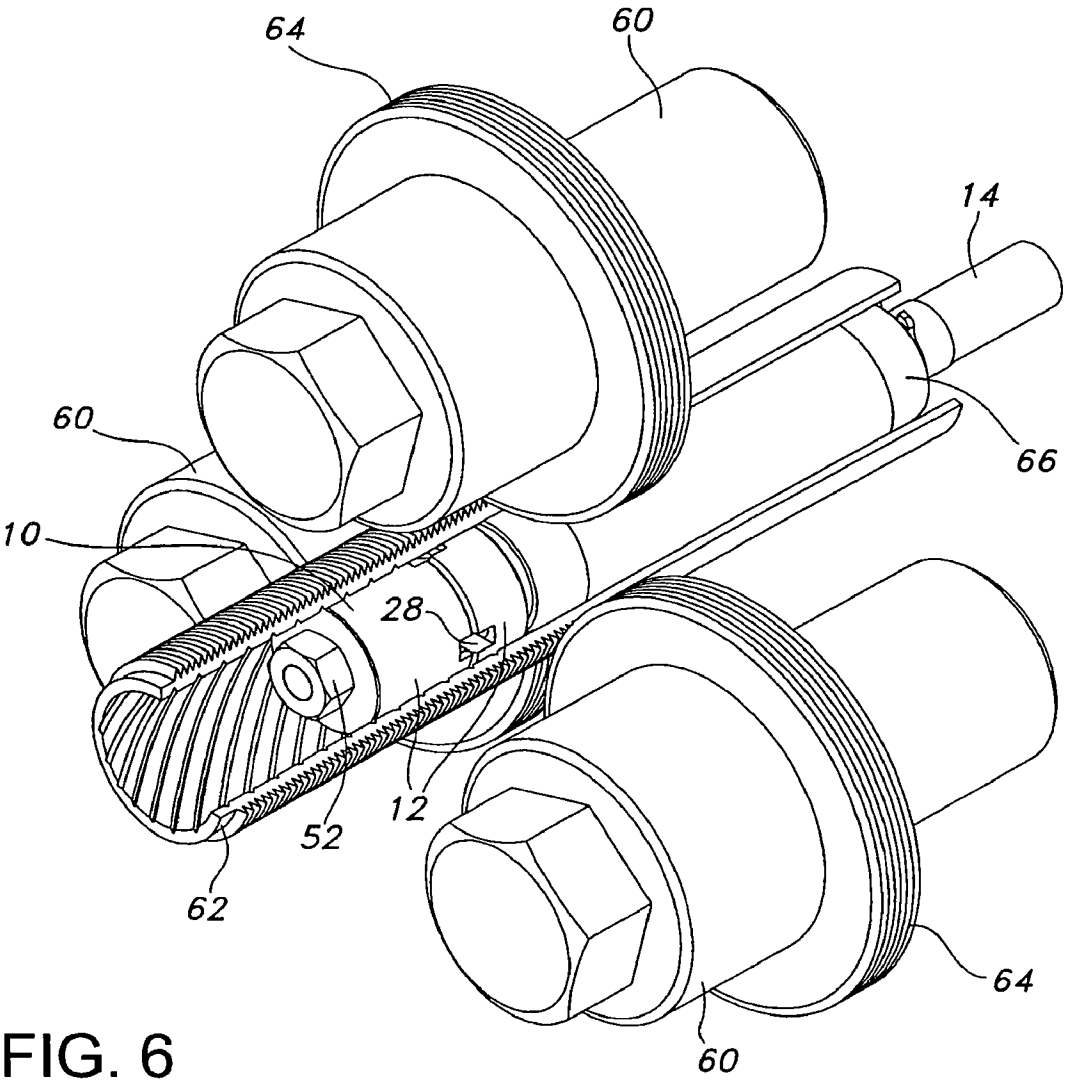
FIG. 6 is a perspective view of the equipment of FIG. 6.

FIGS. 5 and 6 illustrate one possible manufacturing set-up for enhancing the surfaces of tube 62. These figures are in no way intended to limit the process by which tubes in accordance with this invention are manufactured, but rather any tube manufacturing process using any suitable equipment or configuration of equipment may be used. The tubes 62 may be made from a variety of materials possessing suitable physical properties including structural integrity, malleability, and plasticity, such as, for example, copper and copper alloys, aluminum and aluminum alloys, brass, titanium, steel, and stainless steel. FIGS. 5 and 6 illustrate three arbors 60 operating on tube 62 to enhance the outer surface of tube 62. Note that one of the arbors has been omitted from FIG. 5. Each arbor 60 includes a tool set-up having finning disks 64 which radially extrude from one to multiple start outside fins having axial pitch $P_{a,o}$. The tool set-up may include additional disks, such as notching or flattening disks, to further enhance the outer surface of tube. Moreover, while the embodiment shown includes only three arbors 60, fewer or more arbors 60 may be used depending on the desired outer surface enhancements. Note, however, that depending on the tube application, enhancements need not be provided on the outer surface of tube 62 at all.

In one example of a way to enhance inner surface of tube 62, a mandrel shaft 14 onto which mandrel 66 is rotatably mounted extends into tube 62. Tool 10 also is mounted onto shaft 14. Bolt or retaining screw 52 secures tool 10 in place. Tool 10 is preferably locked in rotation with shaft 14 by any suitable means.

In operation, tube 62 generally rotates as it moves through the manufacturing process. Tube wall 68 moves between mandrel 66 and finning disks 64, which exert pressure on tube wall 68. Under pressure, the metal of tube wall 68 flows into the grooves between the finning disks 64 to form fins on the exterior surface of tube 62.

Tool 10 uses the frictional forces of finning to advance cutting bits 28 from within housing 12. When arbors 60 are used, pressure is exerted against tube walls 68. The friction created by the pressure and the movement of the tube 62 in relation to the tool 10 creates an axial force on spacer 18, which advances cutting bits 28 radially and compresses spring 24. When the forces relax, i.e., when the machine stops, spring 24 extends and cutting bits 28 are retracted into housing 12.

The mirror image of a desired inner surface pattern is provided on mandrel 66 so that mandrel 66 will form inner surface of tube 62 with the desired pattern as tube 62 engages mandrel 66. A desirable inner surface pattern includes ridges. After formation of ridges on inner surface of tube 62, tube 62 encounters tool 10 positioned adjacent and downstream mandrel 66. As explained previously, the cutting edge(s) 32 of cutting bit 28 of tool 10 cuts through ridges to form ridge layers. Lifting edge(s) 34 of cutting bit 28 of tool 10 then lift ridge layers to form protrusions.

When protrusions are formed simultaneously with outside finning and tool 10 is fixed (i.e., not rotating or moving axially), tube 62 automatically rotates and has an axial movement. In this instance, the axial pitch of protrusions $P_{a,p}$ is governed by the following formula:

$$P_{a,p} = \frac{P_{a,o} \cdot Z_o}{Z_i}$$

Where:

$P_{a,o}$ is the axial pitch of outside fins;

$Z_o$ is the number of fin starts on the outer diameter of tube; and $Z_i$ is the number of tips on tool.

To obtain a specific protrusion axial pitch $P_{a,p}$, tool 10 can also be rotated. Both tube 62 and tool 10 can rotate in the same direction or, alternatively, both tube 62 and tool 10 can rotate, but in opposite directions. To obtain a predetermined axial protrusion pitch $P_{a,p}$, the necessary rotation (in revolutions per minute (RPM)) of the tool 10 can be calculated using the following formula:

$$RPM_{tool} = \frac{RPM_{tube}(P_{a,o} \cdot Z_o - P_{a,p} \cdot Z_i)}{Z_i \cdot P_{a,p}}$$

Where:

$RPM_{tube}$ is the frequency of rotation of tube;

$P_{a,o}$ is the axial pitch of outer fins;

$Z_o$ is the number of fin starts on the outer diameter of tube;

$P_{a,p}$ is the desirable axial pitch of protrusions; and $Z_i$ is the number of tips on tool.

If the result of this calculation is negative, then tool 10 should rotate in the same direction of tube 62 to obtain the desired pitch $P_{a,p}$. Alternatively, if the result of this calculation is positive, then tool 10 should rotate in the opposite direction of tube 62 to obtain the desired pitch $P_{a,p}$.

Note that while formation of protrusions is shown in the same operation as formation of ridges, protrusions may be produced in a separate operation from finning using a tube with pre-formed inner ridges. This would generally require an assembly to rotate tool 10 or tube 62 and to move tool 10 or tube 62 along the tube axis. Moreover, a support is preferably provided to center tool 10 relative to the inner tube surface.

In this case, the axial pitch $P_{a,p}$ of protrusions is governed by the following formula:

$$P_{a,p} = X_a/(RPM \cdot Z_i)$$

Where:

$X_a$ is the relative axial speed between tube 62 and tool 10 (distance/time);

RMP is the relative frequency of rotation between tool 10 and tube 62;

$P_{a,p}$ is the desirable axial pitch of protrusions; and $Z_i$ is the number of tips 30 on tool 10.

This formula is suitable when (1) the tube 62 moves only axially (i.e., does not rotate) and the tool 10 only rotates (i.e., does not move axially); (2) the tube 62 only rotates and the tool 10 moves only axially; (3) the tool 10 rotates and moves axially but the tube 62 is both rotationally and axially fixed; (4) the tube 62 rotates and moves axially but the tool 10 is both rotationally and axially fixed; and (5) any combination of the above.

While a manufacturing ring setup including arbors has been shown, one with skill in the art will understand that tool 10 may also be used in a manufacturing set up without arbors. For example, tool 10 may incorporate cutting bits 28 that are manually exposed during finning.

The foregoing description is provided for describing various embodiments and structures relating to the invention. Various modifications, additions and deletions may be made to these embodiments and/or structures without departing from the scope and spirit of the invention.

What is claimed is:

1. A tool for cutting the inner surface of a tube comprising:

a. at least one cutting bit comprising:

(i) a tool axis;

(ii) at least one tip formed by the intersection of at least a first plane, a second plane and a third plane;

(iii) a cutting edge; and (iv) a lifting edge;

b. a housing adapted to house at least a part of the at least one cutting bit;

c. a spacer positioned at least partially within the housing, wherein the spacer is adapted to apply pressure to a first surface of the at least one cutting bit to cause at least a portion of the at least one tip of the at least one cutting bit to protrude from the housing when forces are exerted on the spacer; and d. a spring positioned at least partially within the housing, wherein the spring is adapted to expand when the forces relax to exert an expansion force on a second surface of the at least one cutting bit to allow retraction within the housing of the at least a portion of the at least one tip.

2. The tool of claim 1, wherein the cutting edge is formed by the intersection of the first and second planes.

3. The tool of claim 1, wherein the lifting edge is formed by the intersection of the first and third planes.

4. The tool of claim 1, wherein the second plane is oriented at an angle between approximately 40° to 70° relative to the plane perpendicular to the tool axis.

5. The tool of claim 4, wherein the second plane is oriented at an angle such that the cutting edge is adapted to slice through ridges on a tube surface at an angle between approximately 20° to 50° relative to the plane perpendicular to the tool axis.

6. The tool of claim 1, wherein the third plane is oriented at an angle between approximately −45° and 45° relative to the plane perpendicular to the tool axis.

7. The tool of claim 1, wherein the cutting edge is adapted to slice through ridges on an inner surface of the tube at an angle between 20° and 50° to create a plurality of protrusions.

8. The tool of claim 7, wherein the lifting edge is adapted to lift the protrusions at approximately −45° and 45° relative to the plane perpendicular to the tool axis.

9. The tool of claim 1, wherein the tube is adapted to move rotationally and axially relative to the tool when the tool is used to cut the inner surface of the tube.

10. The tool of claim 9, wherein the relative rotation and relative axial movement between the tube and the tool causes the at least a portion of the at least one tip to protrude from the housing.

11. The tool of claim 10, wherein stopping the relative rotation and relative axial movement between the tube and the tool causes the at least a portion of the at least one tip to retract into the housing.

12. The tool of claim 1, wherein the cutting edge is adapted to slice through ridges on an inner surface of the tube at angle between 20° and 50° to create a plurality of protrusions.

13. The tool of claim 12, wherein the lifting edge is adapted to lift the protrusions at an angle between approximately −45° and 45° relative to the plane perpendicular to the longitudinal axis of the tube.

14. A method of enhancing the inner surface of a tube, comprising:

a. mounting a tool onto a shaft, the tool comprising (i) at least one cutting bit comprising:

a tool axis;

at least one tip formed by the intersection of at least a first plane, a second plane and a third plane;

a cutting edge; and a lifting edge;

(ii) a housing adapted to house at least a part of the at least one cutting bit;

(iii) a spacer positioned at least partially within the housing, wherein the spacer is adapted to apply pressure to a first surface of the at least one cutting bit to cause at least a portion of the at least one tip of the at least one cutting bit to protrude from the housing when forces are exerted on the spacer; and (iv) a spring positioned at least partially within the housing, wherein the spring is adapted to expand when the forces relax to exert an expansion force on a second surface of the at least one cutting bit to allow retraction within the housing of the at least a portion of the at least one tip;

b. positioning the tool in the tube;

c. causing relative rotation and relative axial movement between the tube and the tool;

d. cutting at least partially through at least one ridge formed along the inner surface of the tube to form ridge layers; and e. lifting the ridge layers to form protrusions.

15. The method of claim 14, wherein the relative rotation and relative axial movement between the tube and the tool causes the at least a portion of the at least one tip to protrude from the housing.

16. The method of claim 15, wherein stopping the relative rotation and relative axial movement between the tube and the tool causes the at least a portion of the at least one tip to retract into the housing.

17. The method of claim 14, wherein the cutting edge is formed by the intersection of the first and second planes.

18. The method of claim 14, wherein the lifting edge is formed by the intersection of the first and third planes.

* * * * *